US007900334B2

(12) United States Patent
Zimmerman

(10) Patent No.: US 7,900,334 B2
(45) Date of Patent: Mar. 8, 2011

(54) METHOD OF CUSTOMIZING A UTILITY ROD

(75) Inventor: Susan C. Zimmerman, St. Louis, MO (US)

(73) Assignee: Nifty Nob, Inc., St. Louis, MO (US)

( * ) Notice: Subject to any disclaimer, the term of this patent is extended or adjusted under 35 U.S.C. 154(b) by 0 days.

(21) Appl. No.: 12/499,262

(22) Filed: Jul. 8, 2009

(65) Prior Publication Data

US 2009/0271968 A1 Nov. 5, 2009

Related U.S. Application Data

(60) Continuation of application No. 12/018,674, filed on Jan. 23, 2008, now Pat. No. 7,571,532, which is a division of application No. 11/237,532, filed on Sep. 28, 2005, now abandoned.

(51) Int. Cl.
*B23P 11/00* (2006.01)

(52) U.S. Cl. ..... 29/525.01; 29/525.11; 248/251; 211/16; 211/123

(58) Field of Classification Search ..... 29/401.1, 29/402.03, 402.08, 426.1, 428, 525.01, 525.11, 29/525.12; 248/200.1, 251, 222.12, 222.41; 211/16, 88.04, 119.009, 105.1, 123
See application file for complete search history.

(56) References Cited

U.S. PATENT DOCUMENTS 2,199,851 A 5/1940 Culver
4,385,248 A 5/1983 Laskaris
4,829,632 A 5/1989 Frier et al.
4,979,713 A 12/1990 Bell
5,026,013 A 6/1991 Robbins
5,385,248 A 1/1995 Klein, Jr.
5,813,636 A 9/1998 Lollis
5,875,903 A 3/1999 Chen
6,019,233 A 2/2000 Yu
6,276,648 B1 8/2001 Katz et al.
6,371,423 B1 4/2002 Miller
6,578,809 B1 6/2003 Dimella
6,651,830 B2 11/2003 Pan
6,719,156 B2 4/2004 Ellbogen et al.
6,817,044 B1 11/2004 Ouyoung
6,832,445 B2 12/2004 Pitzen

OTHER PUBLICATIONS

File History of related U.S. Appl. No. 11/237,532 as of Jan. 23, 2008.
Notice of Allowance from related U.S. Appl. No. 12/018,674, as of Apr. 3, 2009, 9 pages.

*Primary Examiner* — Jermie E Cozart
(74) *Attorney, Agent, or Firm* — Lathrop & Gage LLP

(57) ABSTRACT

A decorative utility rod assembly that may be attached to a wall or other support surface. The rod assembly has a base rod, a cross rod, a cover plate, a set screw, and a knob or end cap. The proximal (wall) end of the base rod is threaded on its exterior surface. The distal end of the base rod forms a threaded hole. The cover plate forms a threaded hole in a central portion thereof. The cover plate is screwed onto the proximal end of the base rod to hide the wall attachments. One end of set screw is screwed into the threaded hole in the distal end of the base rod. The end cap is screwed onto the other end of the set screw. The cover plate and end cap may be made of a multitude of materials, may have a multitude of surface configurations, may be formed into a multitude of shapes, and may contain indicial of a seasonal, a vanity, an interest of the use, advertising, or decorations to match interior decoration décor. Alternative embodiments include a towel ring, a toilet paper holder, a hook, and shelving.

21 Claims, 13 Drawing Sheets

5

METHOD OF CUSTOMIZING A UTILITY ROD

RELATED APPLICATIONS

This application is a continuation of U.S. patent application Ser. No. 12/018,674, filed Jan. 23, 2008 now U.S. Pat. No. 7,571,532 which is a divisional application of U.S. patent application Ser. No. 11/237,532, filed Sep. 28, 2005, the disclosures of which are incorporated herein by reference now abandoned.

FIELD OF INVENTION

The field of the invention is utility rods and racks that attach to walls. Specifically, the invention relates utility rods the wall mounts of which may be decorated with streamlined, low profile covers of a variety of shapes that hide screws and other wall attachments and the ends of which may be decorated with knobs, medallions, and end pieces, all of which may be easily changed to match room décor and style, or to conform to a seasonal, interest, or vanity theme.

BACKGROUND OF INVENTION

It is common practice to provide utility rods with caps, plates, or other covers to hide the fasteners with which the rods and racks are attached to a wall or other support. Similarly, it is common to provide the ends of rods and racks with caps or plugs that cover the ends of the rods and racks so as to hide the hollow interiors of the rods and racks and cover the exposed, often sharp edges at the ends of the rods and racks.

Unfortunately, the plates, caps, and covers typically require additional structure and attachments such as set screws, clips, or the like. As a result, wall plates and covers frequently stick out from the wall or other mounting surface, because they must incorporate additional parts that permit the cover to be secured. If the covers, caps, or plates are not themselves firmly secured, they may detach under use, causing the towel bar or rack to fall from its mount, expose the wall attachment and fasteners, and/or cause the towel bar or rack to loosen and move about when being used. It is also frequently the case that the wall covers must have a shape that matches the wall mount.

Due to insecure attachments, end caps for rods and bars may also loosen and fall off, exposing the hollow interior of the rod or rack and the sharp, unattractive ends of the rods or racks.

In addition, such end caps, plates, caps, and covers are usually made of the same materials as are the rods and attachments—i.e., they are made to match the utility rod or rack and do not have the flexibility to easily accommodate different shapes or different designs and/or artwork that may better suit the décor of a room, the interests of the users of the rods or racks, or seasonal themes. And, many such end caps cannot be changed without removing the rod or rack from the wall.

For example, Bell U.S. Pat. No. 6,371,423 discloses a wall mount cover arrangement that includes an escutcheon, a backing plate, a stud, seals and grommet, and the resulting wall mount sticks out some distance from the wall. The end cap also includes an assembly of several parts including a head, a hub, a shank, and insert, a ring, and a threaded shank, which is secure, but not easily changed. No provision or suggestion is made for decorative cover plates, decorative end caps, or advertising indicia.

Katz et al. U.S. Pat. No. 6,276,648 includes a spacer that covers a threaded rod to attach the base to the mount, and a slot along the rear surface of the rod. A set screw is used to lock the towel bar in place. A cap covers the distal end of the towel bar. No provision or suggestion is made for decorative cover plates, decorative end caps, or advertising indicia.

Klein U.S. Pat. No. 5,385,248 shows a bulky wall attachment that encloses a set screw that is installed in an apparent separate wall mount. Additional set screws are mounted in the ends of the wall mount attachment to secure a cross rod to the wall mounts. No provision is made for changing decorative wall plates or rod end caps or for placing messages thereon.

SUMMARY OF INVENTION

The present invention features a simple wall mount that may be screwed to the wall or a stud. A base mount extends outward from the wall mount. The bottom portion of the base is threaded. A cover plate, which may be any shape and decorated in any fashion, has a threaded central hole that slides on and over the base mount or rod and is screwed to the threading bottom portion of the base. A hole in the side of the base rod accommodates the end of a cross rod. Alternatively, a hole entirely through the base may accommodate a ring to hold a towel or other object.

The exposed end of any rod is closed and provided with a threaded hole into which a set screw is threaded; the outward or exposed end of the set screw is covered with an end cap which has a threaded central hole that is screwed onto the exposed end of the set screw. The end cap may be of any shape and decorated in any fashion. The set screw at the end of the rod may also be screwed into a threaded hole near the end of a cross rod to secure the cross rod to the base rod.

The decorative wall or mount cover plate may be changed by simply unscrewing it from the end of the base rod near the wall or other mounting surface and replacing it with another end cap embodying a different shape or decoration. Similarly, the decorative end cap may be replaced by simply unscrewing it and replacing it with another end cap embodying a different shape or decoration.

The cover plates and end caps of the invention may also be made of materials that are different from the balance of the utility rod. Such materials may be metal, plastic, wood, stone, or any other material into which a threaded hole may be formed or added.

The cover plates and end caps may also be made of nearly any shape or surface configuration to suit the desires of the user. They may be made of three dimensional shapes or shapes having flat surfaces that may contain logos, an initials, seasonal indicia, artwork, advertising indicia, and combinations thereof.

DETAILED DESCRIPTION

Figure 1:
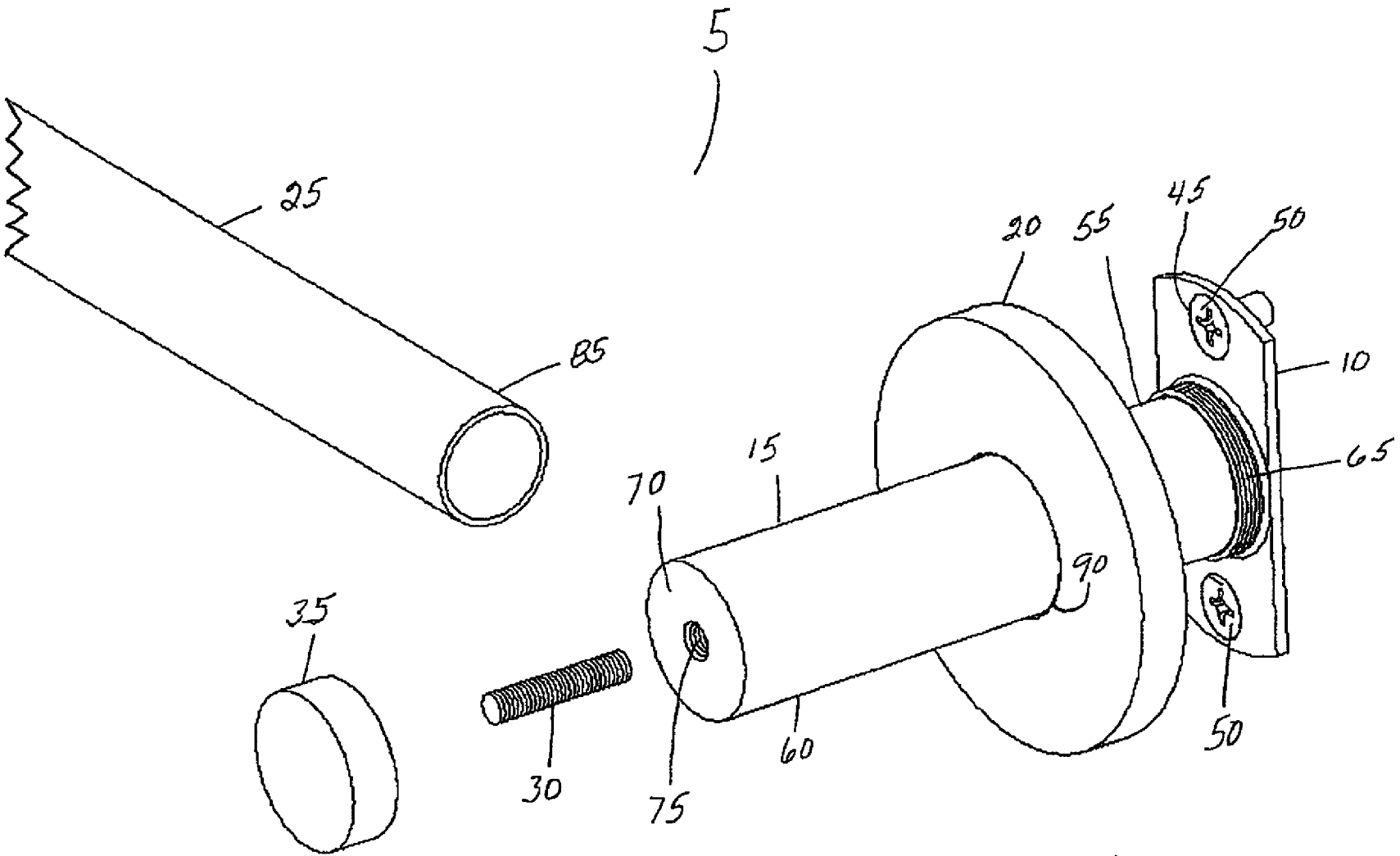
FIG. 1 is a perspective exploded view of a utility rod assembly of the invention.
Figure 2:
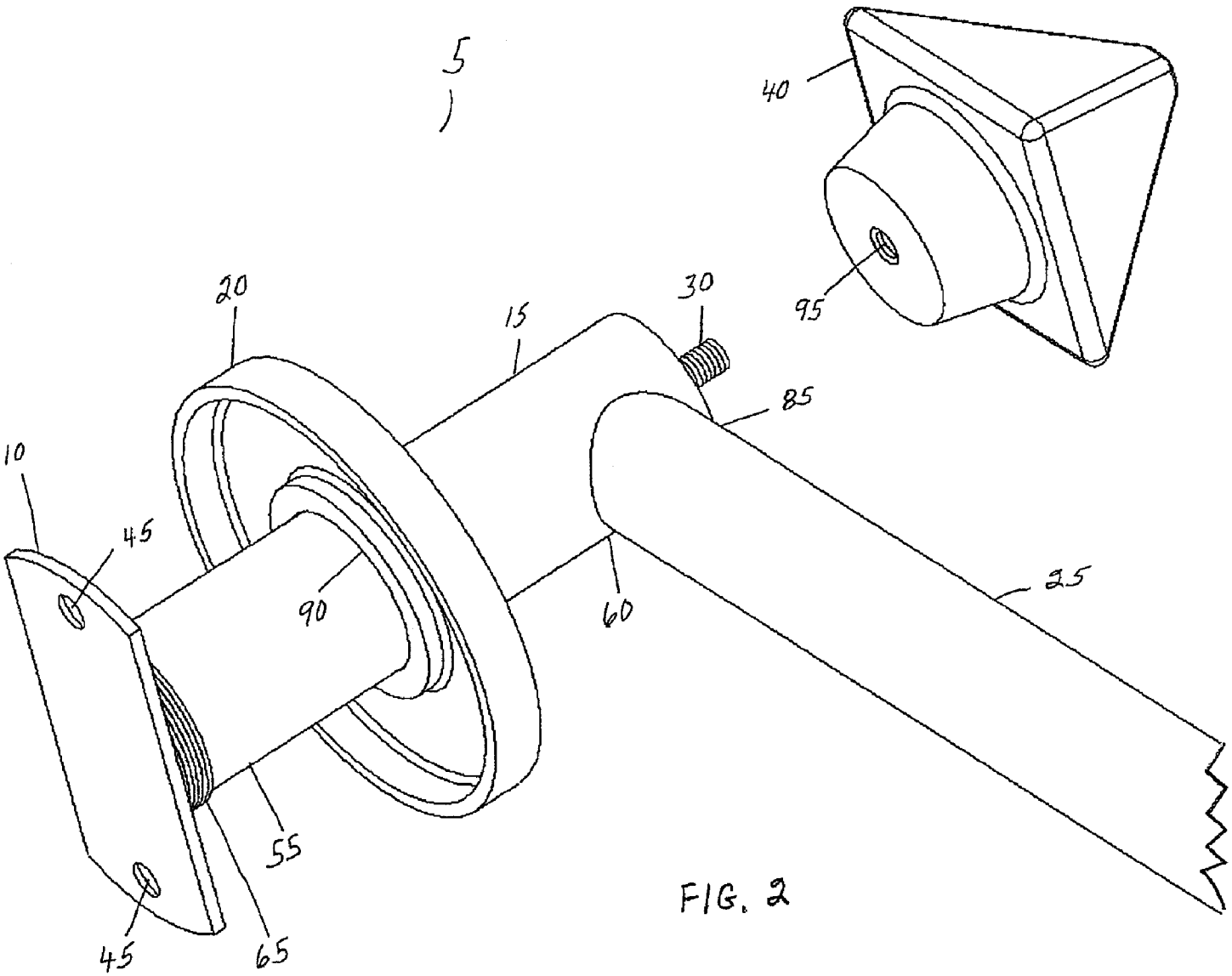
FIG. 2 is a perspective exploded view of a second embodiment of a rod assembly.

As shown in FIGS. 1 and 2, the utility rod assembly 5 comprises a wall attachment plate 10, a base rod 15, a cover plate 20, a cross rod 25, a set screw 30, and a knob or end cap 35. FIG. 2 shows the same basic parts, but has a knob or end cap 40 of a different style or shape.

As shown in FIG. 2, the wall attachment plate 10 contains holes 45 through which the base rod 15 may be secured to a wall or stud (not shown) by screws 50.

Figure 3:
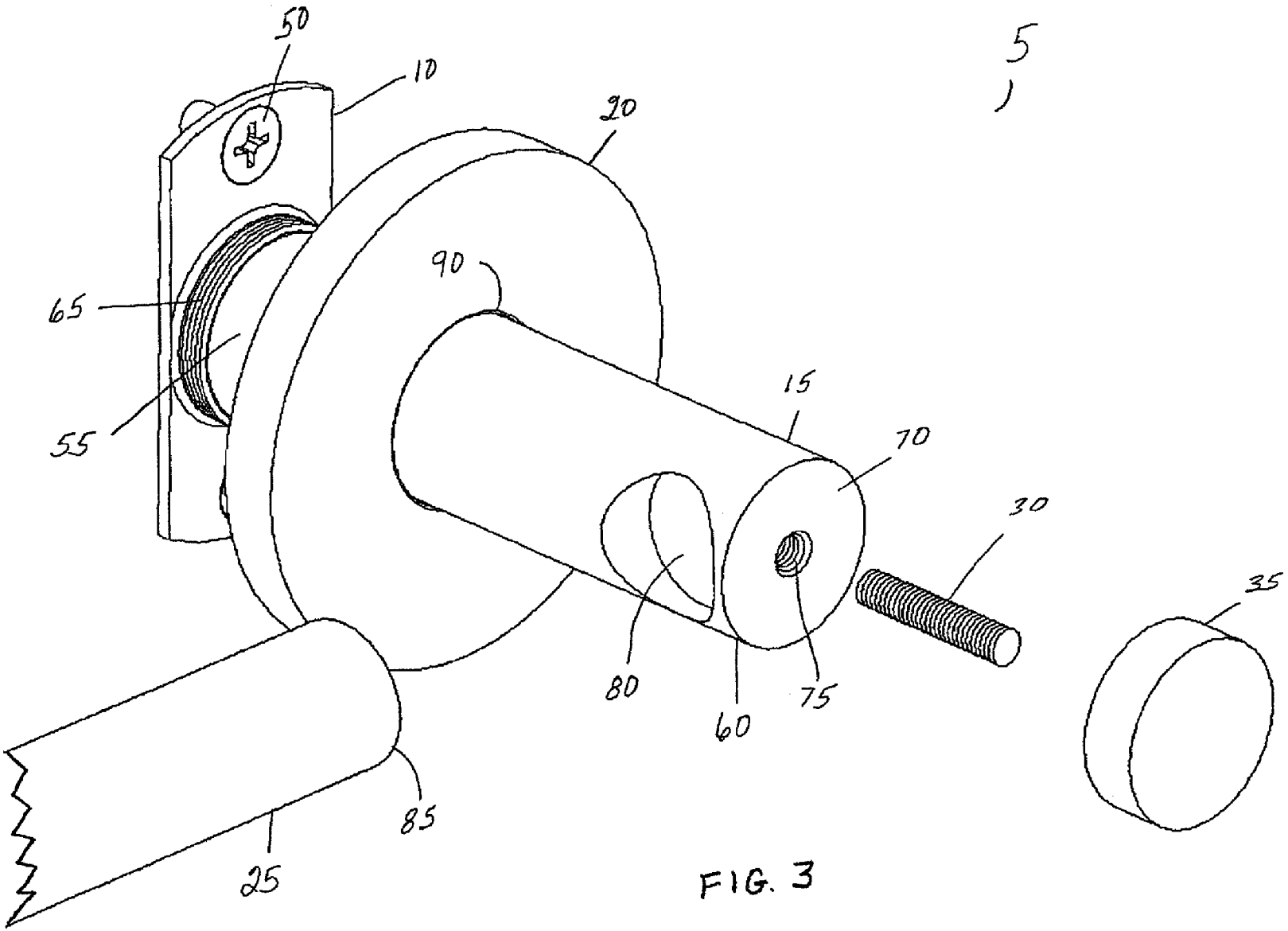
FIG. 3 is a perspective exploded view of the rod assembly from another perspective.
Figure 4:
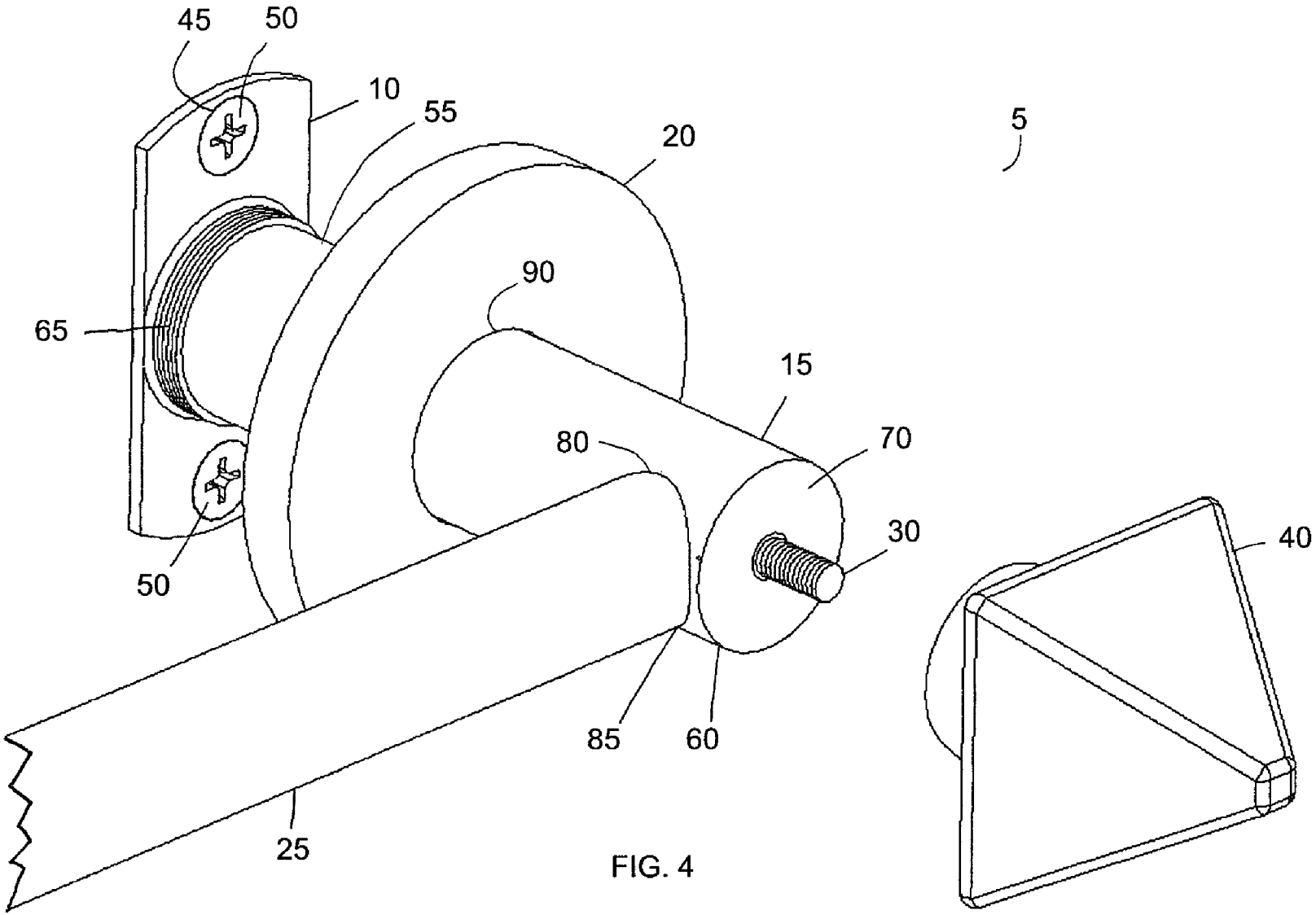
FIG. 4 is a perspective partially exploded view of the second embodiment from another perspective.
Figure 5:
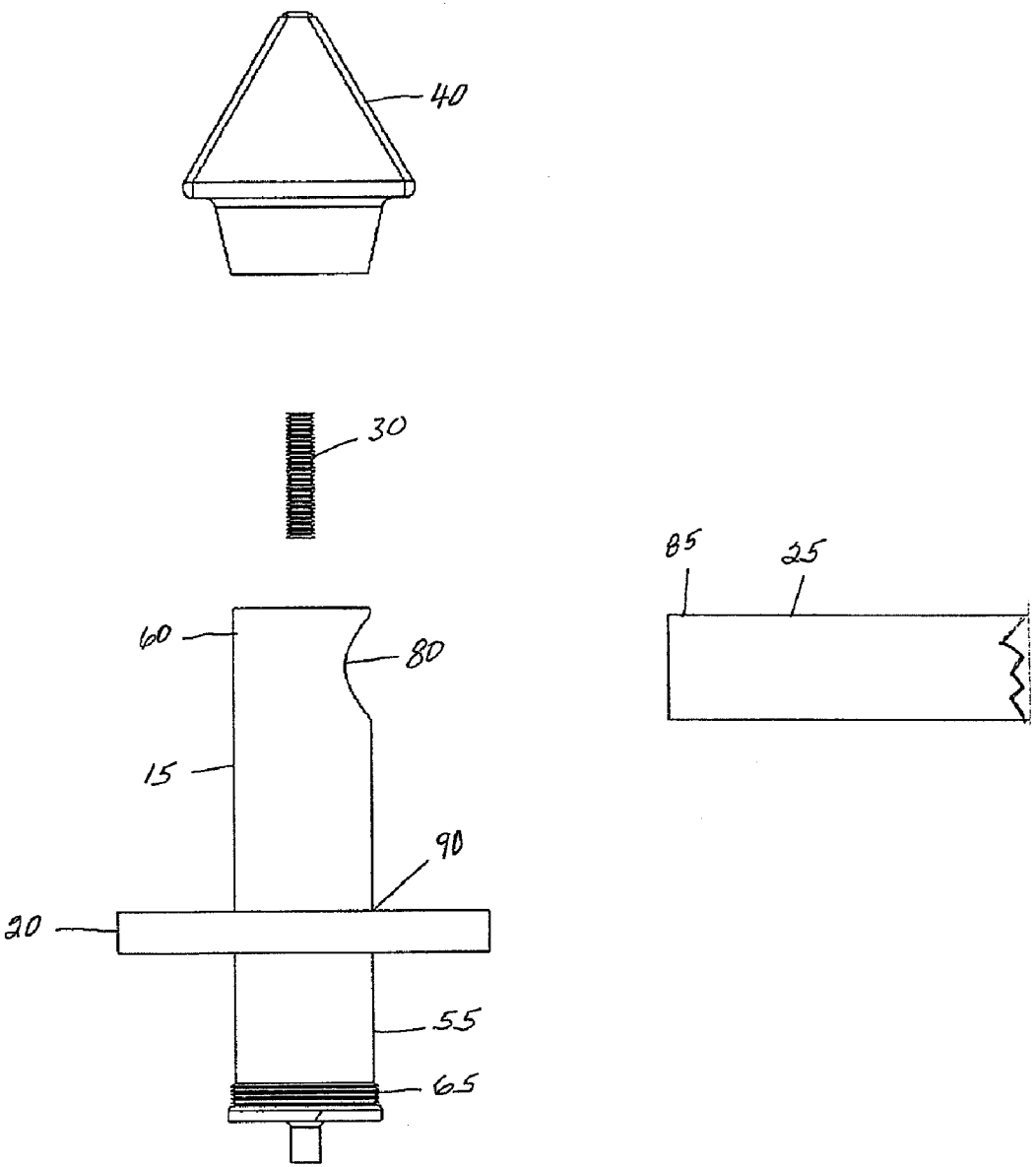
FIG. 5 is a top exploded view of the second embodiment.
Figure 6:
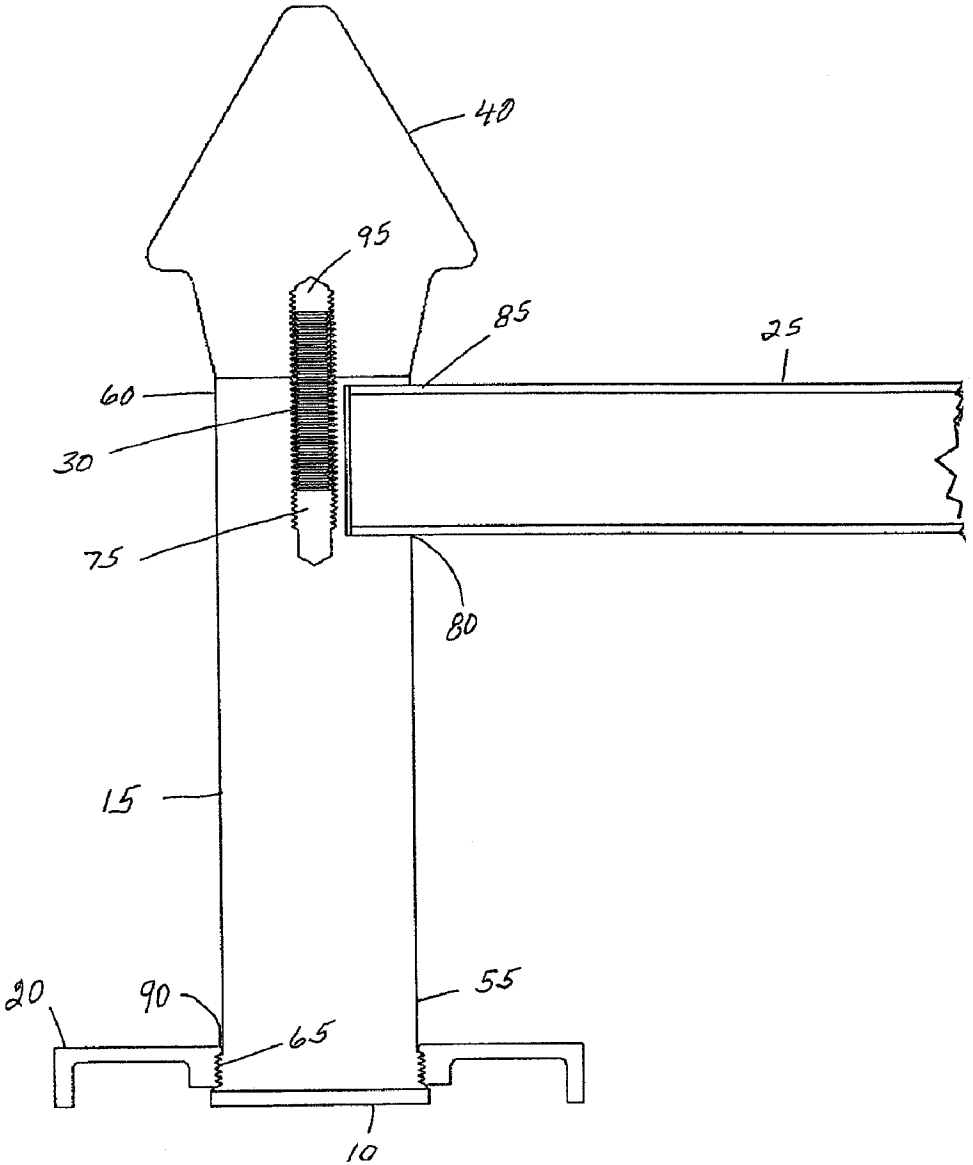
FIG. 6 is a top cross sectional view of the second embodiment.

The base rod 15 is incorporated in the attachment plate 10. As shown in FIGS. 1, 3, 4, 5 and 6, a proximal end 55 of the base rod 5 is slightly larger in diameter than the distal end 60 of the base rod 5. As shown in FIGS. 1, 3, and 6, the proximal end 55 of the base rod 5 is threaded, containing threads 65. The distal end 60 of the base rod 5 contains a solid end or plug 70, which forms a threaded hole 75. As shown in FIGS. 3, 5, and 6, the distal end 60 of the base rod 5 also contains a side hole 80 that is sized to receive an end 85 of the cross rod 25.

The cover plate 20 forms a central hole 85 that is threaded.

The set screw 30 is completely threaded; if desired half of the set screw may be threaded in the reverse direction from the other half.

As shown in FIGS. 2 and 6, end caps 35 and 40 each form a threaded hole 90. The set screw 30 is screwed about half way into the plug or solid end 70 of the base rod 15, and the end cap 35 or 40 is screwed onto the half of the set screw 30 that remains outside of the plug or solid end 70 of the base rod 15.

Figure 7:
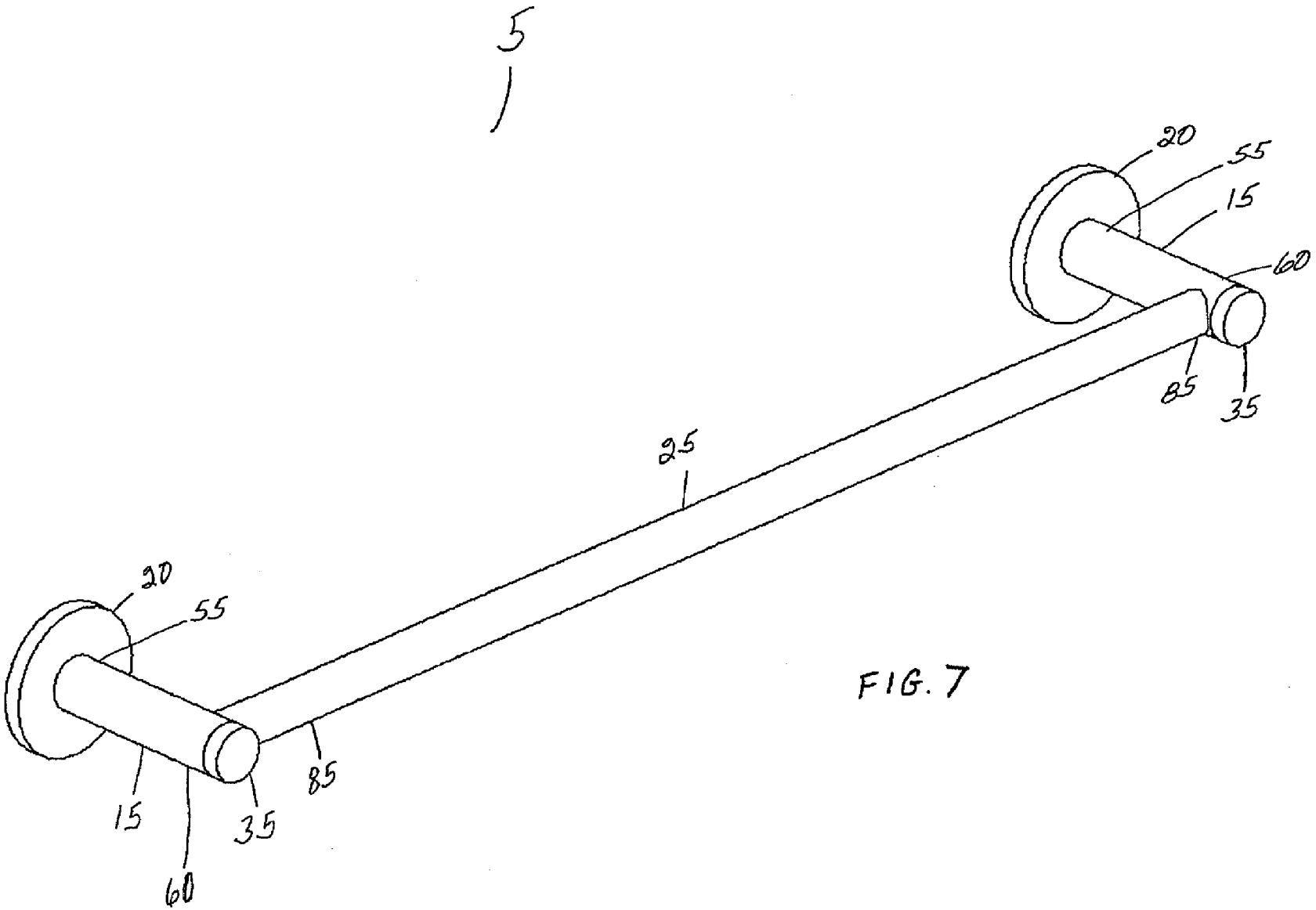
FIG. 7 is a perspective view of the fully assembled utility rod assembly attached to a wall or other surface (not shown)

A typical utility rod assembly is attached to the wall or support surface at two locations as shown in FIG. 7. Such a utility rod assembly would of course contain one cross rod 25, two wall attachment plates 10, two base rods 15, two cover plates 20, two set screws 30, and two end caps 35 or 40.

The rod assembly 5 is assembled by screwing the wall attachment plates 10 into a wall. The cover plates 20 are then placed over their respective base rods 15 and screwed down over the wall attachment plate 10 to hide the attachment plate 10 and its screws 50.

The cross rod 25 is then inserted into the side holes 80 of at the distal ends of the base rods 5. The set screws 30 are then threaded into the solid end or plugs 70 at the distal ends 60 of the base rods 15. The end caps 35 or 40 are then screwed onto the exposed ends of the set screws 30.

As will be appreciated from the above, the cover plates 20 are not limited to the round shape show in the drawings. Indeed, the cover plates 20 may be made of any shape that permits a threaded central hole 90 to be placed therein. Thus, the cover plates may be made in such varied shapes as footballs, flowers, initials, Thanksgiving turkeys, or cartoon characters. Alternatively, the cover plates 20 may be circular or rectangular and contain painted or raised scenes or decorations.

As will also be appreciated from the above, the end caps 35 or 40 are similarly not limited to the shapes shown in the drawings. They, too, may be made in such varied shapes as flowers, initials, animals, logos, cartoon characters, gems, or other objects.

Indeed, neither the cover plates 20 nor the end caps 35 or 40 need be made of the same material as the other parts of the utility rod assembly 5. They may be made of any material into which a threaded hole such as 45 or 95 may be formed. Thus, the end caps and cover plates may be made of metal, wood, plastic, stone, or other substances which add to the theme, vanity, décor, or style desired by the user. The end caps and cover plates may also be made of a material such as metal or wood with a veneer of another material that may be painted or other wise formed or decorated by the user.

Further, the end caps 35 or 40 and cover plate 20 may present a shape or surface configuration that is round, oval, square, octagonal, rectangular, triangular, octagonal, pentagonal, quadrilateral, any combination of the forgoing, or any other shape that permits a threaded hole to be formed therein.

The utility rod assembly 5 thus has maximum flexibility to suite the tastes of the users, allowing for different themes, styles, artwork, or seasonal expressions. Thus, the cover plate 20 or end caps 35 or 40 may contain paintings, drawings, messages, Christmas decorations, Independence Day decorations, flags, Thanksgiving decorations, logos, shields, medallions, or advertising indicia. In commercial establishments, the cover plate 20 and end caps 35 or 40 may contain advertising indicia of the commercial establishment or some other commercial venture.

As can be further appreciated from the above description, the end caps 35 or 40 may be changed very easily simply by unscrewing the end caps 35 or 40 and screwing on a differently decorated set without the necessity of removing the cross rod 25 or otherwise dissembling or removing the utility rod 5 or base rods 15 from the wall. Moreover, the cover plates 20 may be changed by removing only the cross rod 25 from the assembly 5.

Figure 8:
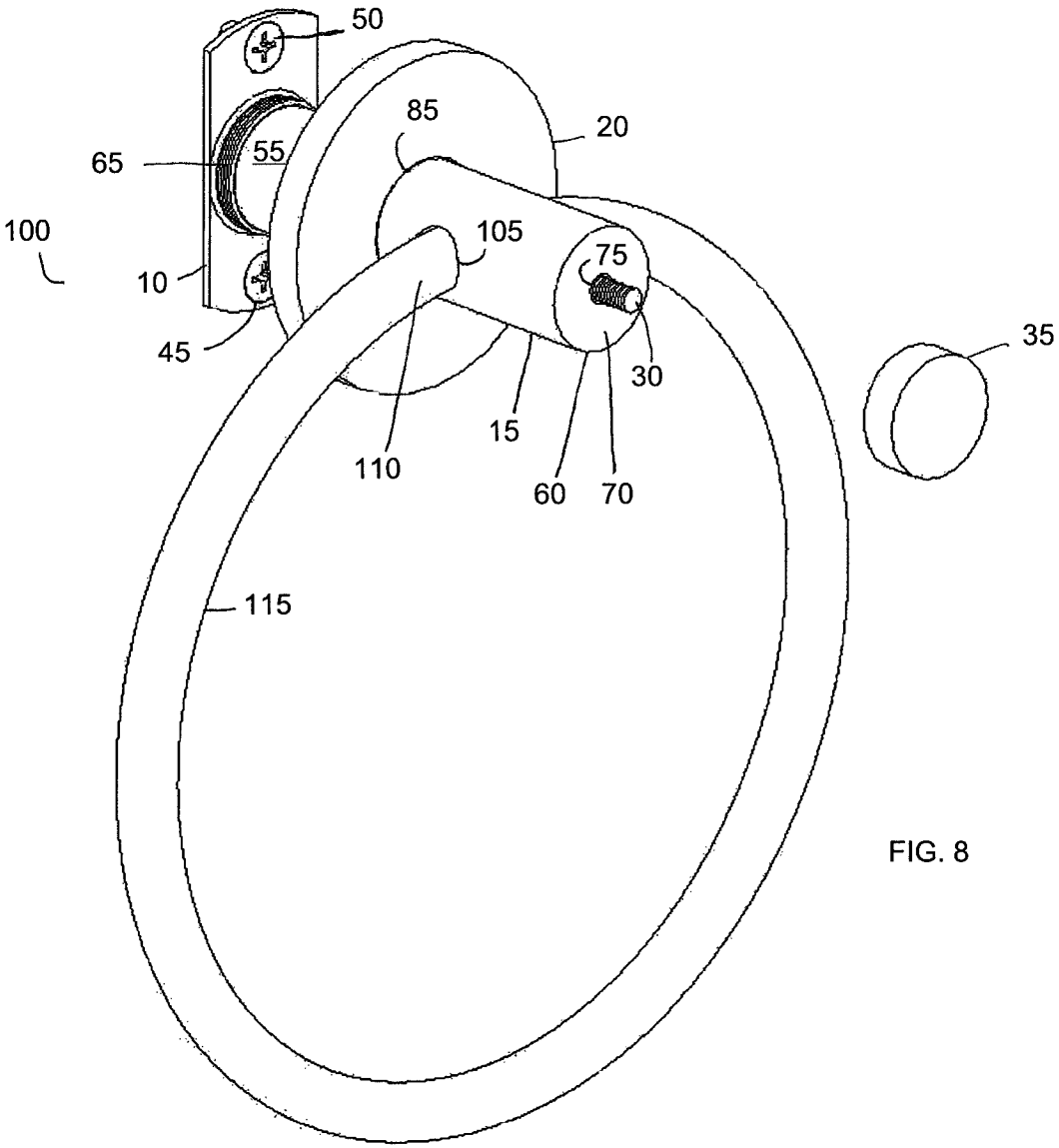
FIG. 8 is a perspective, partially exploded view of a towel ring assembly, another embodiment of the invention.
Figure 9:
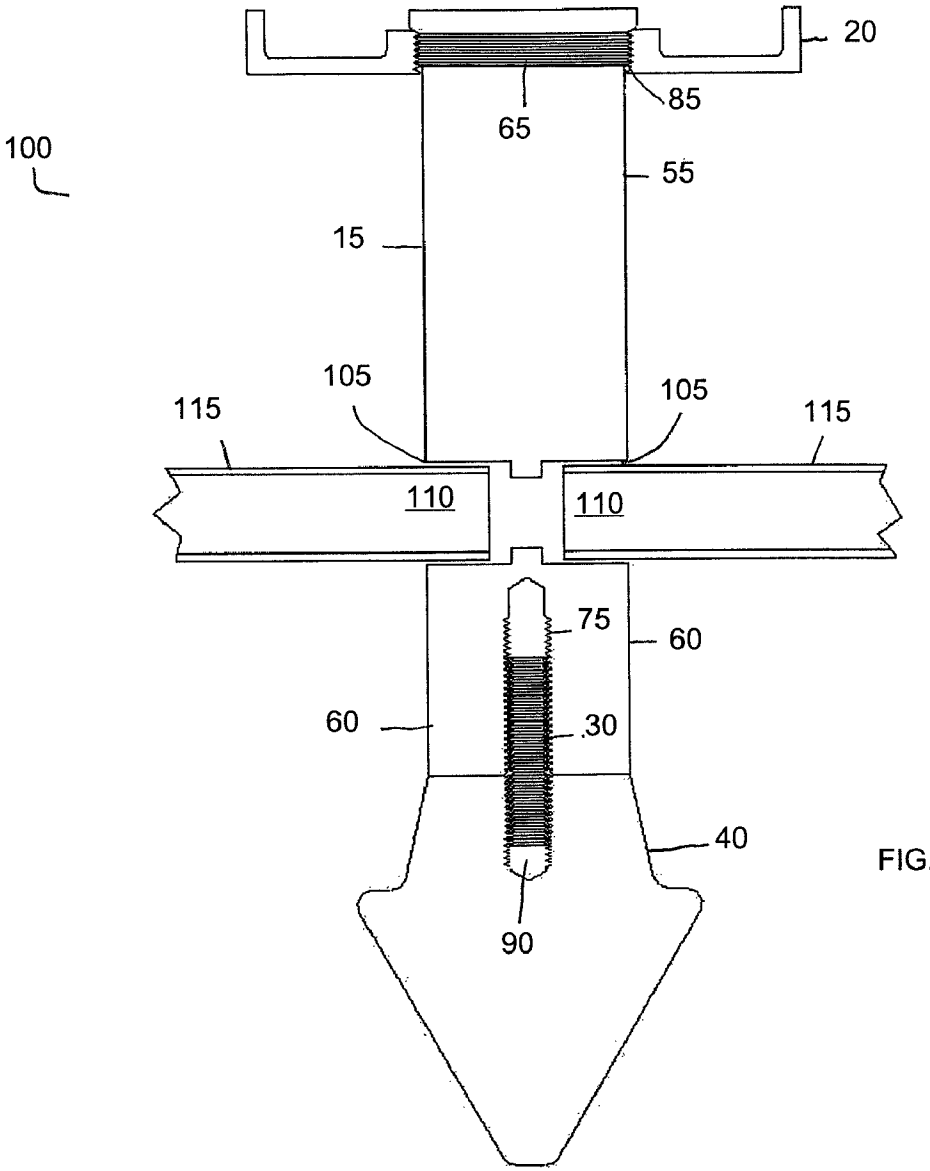
FIG. 9 is a partial, top cross sectional view of the towel ring assembly of FIG. 8.

FIGS. 8 and 9 show another embodiment of the invention, a towel ring assembly 100. The towel ring assembly 100 is similar to the utility rod 5 shown in FIGS. 1 and 2, having a wall attachment plate 10, a base rod 15, a cover plate 20, a set screw 30, and end caps 35 and 40 (See FIGS. 8 and 9, respectively.) The wall attachment plate 10 contains holes 45 through which the base rod 15 may be secured to a wall or stud (not shown) by screws 50. The base rod 15 is incorporated in the attachment plate 10. A proximal end 55 of the base rod 5 is slightly larger in diameter than the distal end 60 of the base rod 15. The proximal end 55 of the base rod 5 is threaded, containing threads 65.

The distal end 60 of the base rod 15 contains a solid end or plug 70, which forms a threaded hole 75. The base rod 5 also contains a side hole 105 on both sides thereof, each of which is sized to receive an end 110 of a towel ring 115. The cover plate 20 forms a central hole 85 that is threaded. The set screw 30 is completely threaded; if desired half of the set screw may be threaded in the reverse direction from the other half. End caps 35 and 40 each form a threaded hole 90 (see FIG. 9). The set screw 30 is screwed about half way into the plug or solid end 70 of the base rod 15, and the knob or end cap 35 or 40 is screwed onto the half of the set screw 30 that remains outside of the plug or solid end 70 of the base rod 15.

As shown in FIGS. 8 and 9, the ends of the towel ring 115 are fit into the holes 105 in the sides of the base rod 5. A towel may be placed in the towel ring 115. The end cap 35 or 40, or another style of end cap, or an end cap made of other materials, may be placed on the end of the base rod 15. As before, the cover plate 20 may be of a different design or made of different materials, as well.

Figure 10:
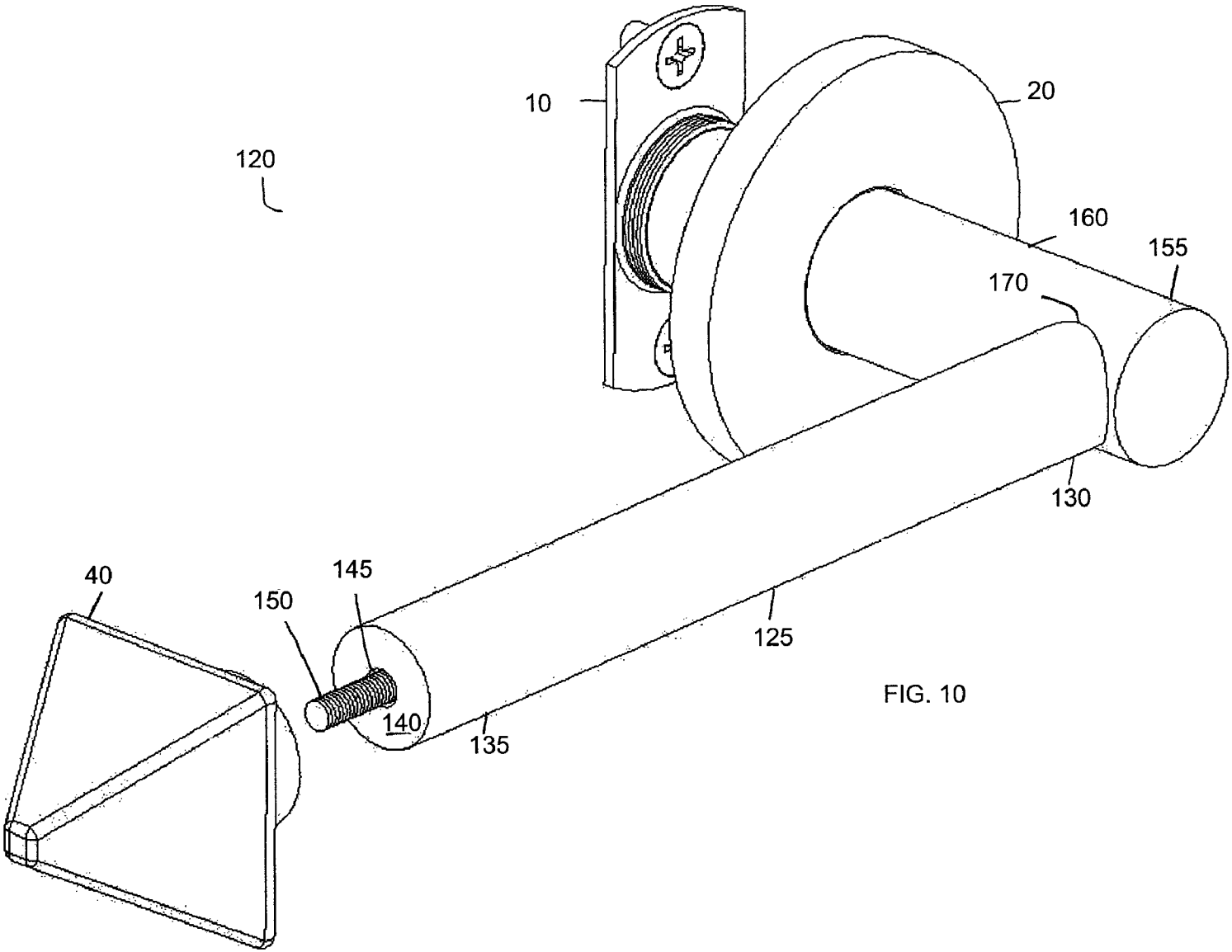
FIG. 10 is a perspective, partially exploded view of a toilet paper holder assembly, another embodiment of the invention.
Figure 11:
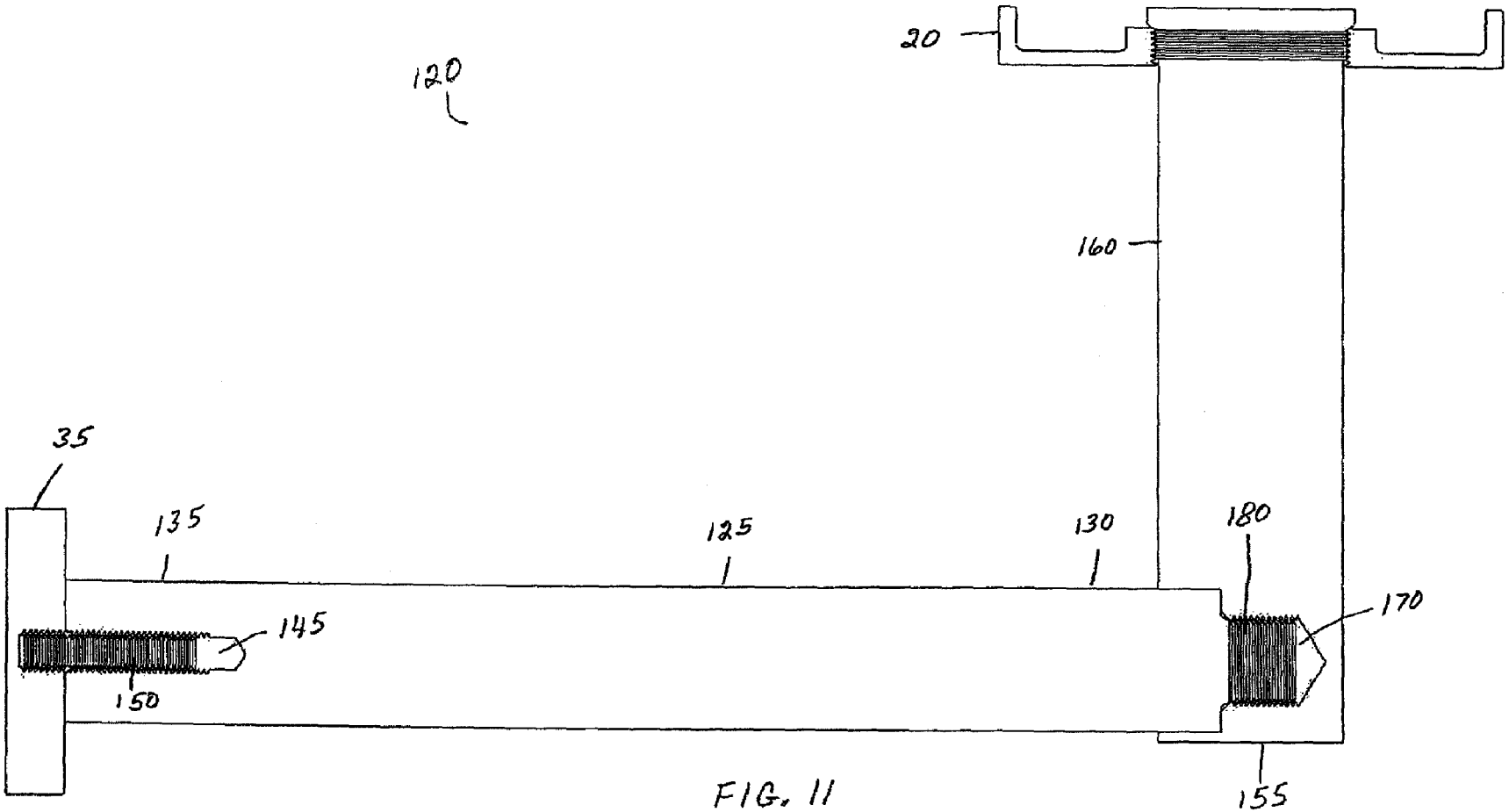
FIG. 11 is a partial, top cross sectional view of the toilet paper holder assembly of FIG. 10.

FIGS. 10 and 11 show another embodiment of the invention, a toilet paper holder assembly 120. The wall attachment plate 10 and cover plate 20 the same as those shown in FIGS. 1 and 2, with the same parts and attachments. A toilet paper rod 125 has a proximal end 130 and a distal end 135. The distal end 135 has a plug or solid end 140 with a threaded hole 145. The end cap 35 or 40 (see FIGS. 11 and 10, respectively) is secured to the distal end 135 of the toilet paper rod 125 by a threaded set screw 150 that is the same as the set screw 30 shown in FIGS. 1 and 2.

A distal end 155 of a base rod 160 has a threaded hole 170. The proximal end 130 of the toilet paper rod 125 has a threaded insert 180. The threaded insert 180 of the proximal end 130 of the toilet paper rod 125 is screwed into the threaded hole 170 in the base rod 160.

Again, the end cap 35 or 40, or another style of end cap, or an end cap made of other materials, may be screwed on the end of the toilet paper rod 125. As before, the cover plate 20 may be of a different design or made of different materials, as well.

Figure 12:
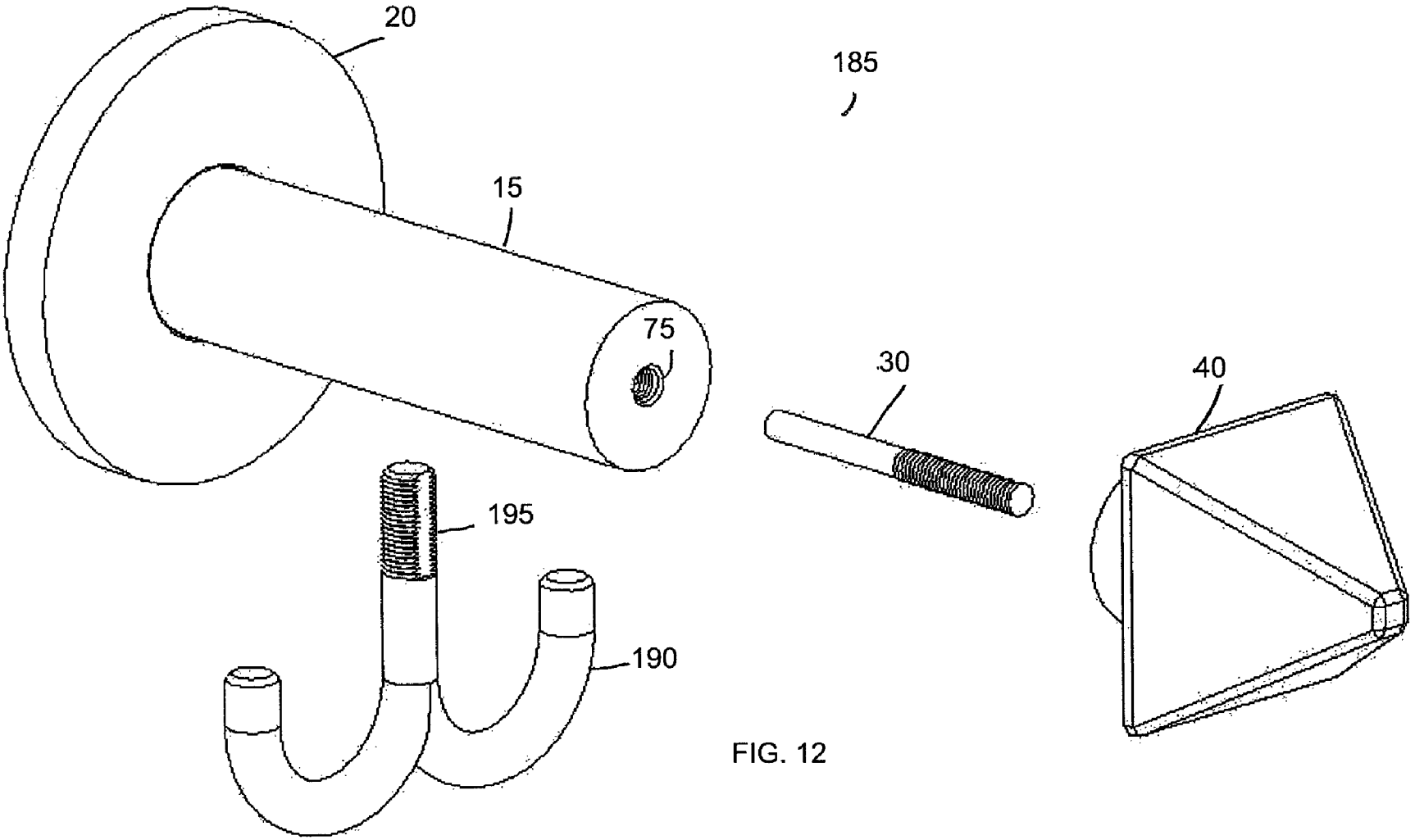
FIG. 12 is a perspective, partially exploded view of a hook assembly, another embodiment of the invention.
Figure 13:
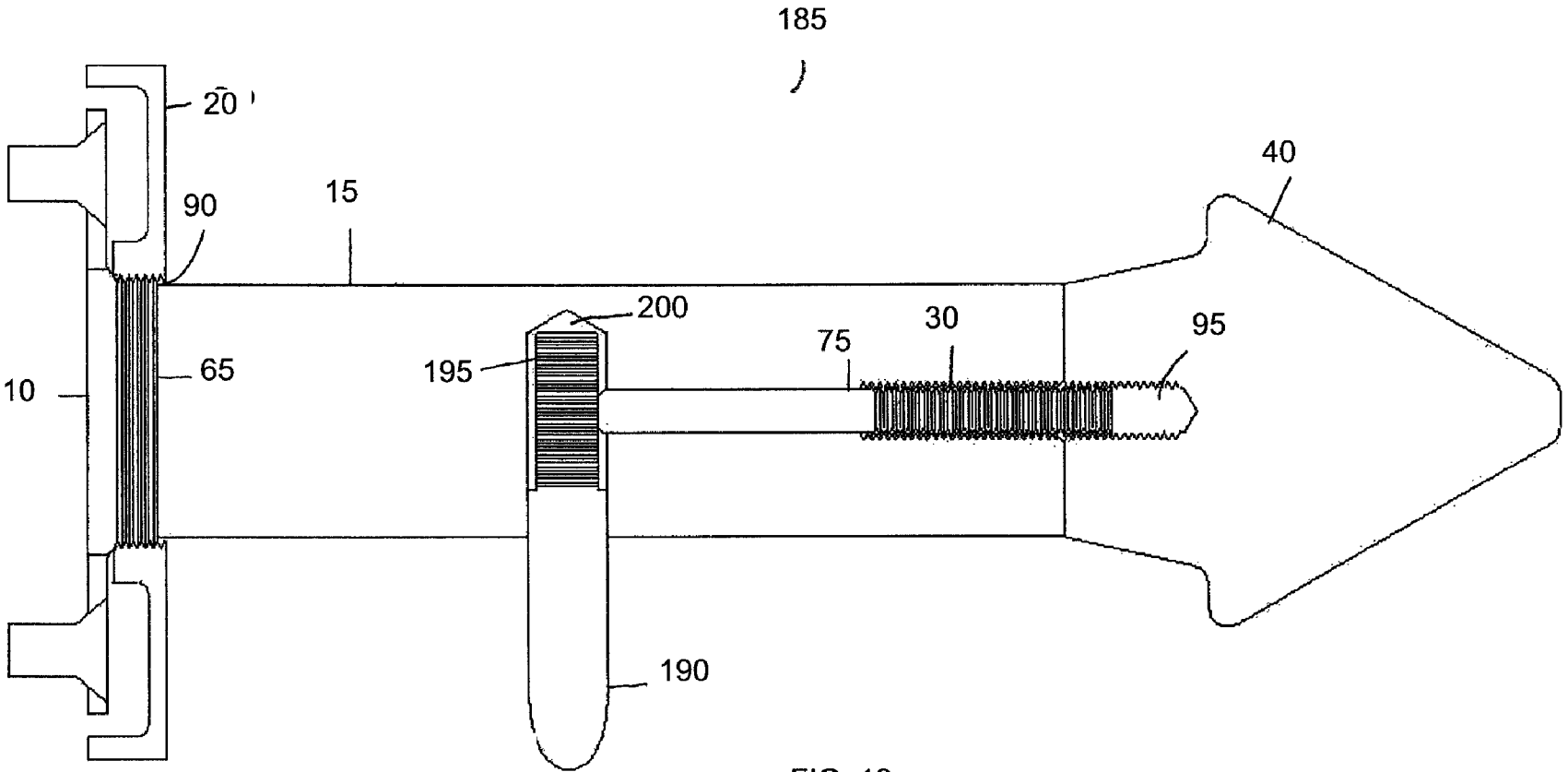
FIG. 13 is a side view of the embodiment of FIG. 12 with a partial cross sectional view of the threaded attachments for an end cap and a hook.

FIGS. 12 and 13 show a hook assembly 185 comprising a wall attachment plate 10, a cover plate 20, a base rod 15, a set screw 30, a knob or end cap 40, and a hook 190. The wall attachment plate 10, cover plate 20, base rod 15, set screw and end cap 40 are constructed and assembled, serve the same purposes, perform the same functions, and have the same decorative features and flexibility as the similar parts described above with respect to the utility rod of FIGS. 1 and 2.

The hook 190 has a threaded post 195 that screws into a hole 200 in the bottom of the base rod 15.

The end cap or knob 40, or another style of end cap, or an end cap made of other materials, may be screwed on the end of the hook assembly 185. The cover plate 20 may also be of a different design or made of different materials.

With minor changes, the utility rod assembly 5 shown in FIGS. 1 and 2 may be reconfigured as shelving with the cover plate 20 covering the wall attachment plate 10 and providing decorating flexibility and with the end caps or knobs 35 or 40 providing further decorating flexibility. As will be readily apparent, the utility rod assembly 5 of FIGS. 1 and 2 may be converted to a shelving design by lengthening the base rods 15, and providing threaded holes in the sides of and along the length of each base rod 15. Multiply cross rods similar to cross rod 25 may then be inserted or screwed into the holes to provide shelving. The flexible, decorative aspects of the cover plate 20 and end caps 35 or 40, or end caps or knobs with other desired shapes or styles or made from other materials, remain. Thus, such shelving serves the decorating styles and desires of the user.

What is claimed is as follows:

1. A method of customizing a utility rod having a base rod presenting proximal and distal ends, the proximal end having an attachment plate and being threaded, the distal end having a set screw extending therefrom, the method comprising the steps:

a) coupling a first cover plate having a threaded hole to the base rod proximal end to hide the attachment plate, the first cover plate threaded hole interacting with the threaded base rod proximal end to couple the first cover plate to the base rod proximal end;

b) coupling a first end cap having a threaded hole to the set screw to secure the first end cap adjacent the base rod distal end, the first end cap threaded hole interacting with the set screw to couple the first end cap to the set screw;

c) disengaging the first cover plate threaded hole from the threaded base rod proximal end;

d) separating the first cover plate from the base rod;

e) coupling a second cover plate having a threaded hole to the base rod proximal end to hide the attachment plate, the second cover plate threaded hole interacting with the threaded base rod proximal end to couple the second cover plate to the base rod proximal end;

f) separating the first end cap from the base rod by removing the first end cap from the set screw; and g) coupling a second end cap having a threaded hole to the set screw to secure the second end cap adjacent the base rod distal end, the second end cap threaded hole interacting with the set screw to couple the second end cap to the set screw;

wherein the first cover plate has a configuration that is different than a configuration of the second cover plate;

wherein the first cover plate is functionally equivalent to the second cover plate;

wherein the first end cap has a configuration that is different than a configuration of the second end cap; and wherein the first end cap is functionally equivalent to the second end cap.

2. The method of claim 1, wherein at least one of the first cover plate, the first end cap, the second cover plate, and the second end cap is formed out of a material selected from a group consisting of wood, metal, plastic, stone, and combinations thereof.

3. The method of claim 1, wherein:

the configuration of the first cover plate includes at least one of shape and indicia;

the configuration of the second cover plate includes at least one of shape and indicia;

the configuration of the first end cap includes at least one of shape and indicia;

the configuration of the second end cap includes at least one of shape and indicia.

4. The method of claim 1, wherein the configuration of at least one of the first cover plate, the second cover plate, the first end cap, and the second end cap includes at least one of a logo, an initial, seasonal indicia, artwork, and advertising indicia.

5. The method of claim 1, wherein:

the configuration of the first cover plate and the configuration of the first end cap collectively present a first theme; and the configuration of the second cover plate and the configuration of the second end cap collectively present a second theme.

6. The method of claim 5, wherein at least one of the first theme and the second theme is a seasonal theme.

7. The method of claim 1, wherein at least one cross rod is removably connected to the base rod to form at least one of a towel rod, a toilet paper holder, and shelving.

8. A method of customizing a utility rod having a base rod presenting proximal and distal ends, the proximal end having an attachment plate and being threaded, the distal end having a set screw extending therefrom, the method comprising the steps:

a) coupling a first cover plate having a threaded hole to the base rod proximal end to hide the attachment plate, the first cover plate threaded hole interacting with the threaded base rod proximal end to couple the first cover plate to the base rod proximal end;

b) coupling a first end cap having a threaded hole to the set screw to secure the first end cap adjacent the base rod distal end, the first end cap threaded hole interacting with the set screw to couple the first end cap to the set screw;

c) separating the first end cap from the base rod by removing the first end cap from the set screw; and d) coupling a second end cap having a threaded hole to the set screw to secure the second end cap adjacent the base rod distal end, the second end cap threaded hole interacting with the set screw to couple the second end cap to the set screw;

wherein the first end cap has a configuration that is different than a configuration of the second end cap;

wherein the first end cap is functionally equivalent to the second end cap; and wherein a hook is removably connected to the base rod.

9. The method of claim 8, further comprising the steps:

disengaging the first cover plate threaded hole from the threaded base rod proximal end;

separating the first cover plate from the base rod; and coupling a second cover plate having a threaded hole to the base rod proximal end to hide the attachment plate, the second cover plate threaded hole interacting with the threaded base rod proximal end to couple the second cover plate to the base rod proximal end; and wherein the first cover plate has a configuration that is different than a configuration of the second cover plate; and wherein the first cover plate is functionally equivalent to the second cover plate.

10. The method of claim 9, wherein at least one of the first cover plate, the first end cap, the second cover plate, and the second end cap is formed out of a material selected from a group consisting of wood, metal, plastic, stone, and combinations thereof.

11. The method of claim 9, wherein:

the configuration of the first cover plate includes at least one of shape and indicia;

the configuration of the second cover plate includes at least one of shape and indicia;

the configuration of the first end cap includes at least one of shape and indicia;

the configuration of the second end cap includes at least one of shape and indicia.

12. The method of claim 9, wherein the configuration of at least one of the first cover plate, the second cover plate, the first end cap, and the second end cap includes at least one of a logo, an initial, seasonal indicia, artwork, and advertising indicia.

13. The method of claim 9, wherein:

the configuration of the first cover plate and the configuration of the first end cap collectively present a first theme; and the configuration of the second cover plate and the configuration of the second end cap collectively present a second theme.

14. The method of claim 13, wherein at least one of the first theme and the second theme is a seasonal theme.

15. A method of customizing a utility rod having a base rod presenting proximal and distal ends, the proximal end having an attachment plate and being threaded, the distal end having a set screw extending therefrom, the method comprising the steps:

a) coupling a first cover plate having a threaded hole to the base rod proximal end to hide the attachment plate, the first cover plate threaded hole interacting with the threaded base rod proximal end to couple the first cover plate to the base rod proximal end;

b) coupling a first end cap having a threaded hole to the set screw to secure the first end cap adjacent the base rod distal end, the first end cap threaded hole interacting with the set screw to couple the first end cap to the set screw;

c) separating the first end cap from the base rod by removing the first end cap from the set screw; and d) coupling a second end cap having a threaded hole to the set screw to secure the second end cap adjacent the base rod distal end, the second end cap threaded hole interacting with the set screw to couple the second end cap to the set screw;

wherein the first end cap has a configuration that is different than a configuration of the second end cap;

wherein the first end cap is functionally equivalent to the second end cap wherein the base rod forms a hole on both sides thereof adjacent the distal end; and wherein a ring having two separated ends facing one another is removably coupled to the base rod by fitting each of the separated ends into a respective hole adjacent the base rod distal end.

16. The method of claim 15, further comprising the steps:

disengaging the first cover plate threaded hole from the threaded base rod proximal end;

separating the first cover plate from the base rod; and coupling a second cover plate having a threaded hole to the base rod proximal end to hide the attachment plate, the second cover plate threaded hole interacting with the threaded base rod proximal end to couple the second cover plate to the base rod proximal end; and wherein the first cover plate has a configuration that is different than a configuration of the second cover plate; and wherein the first cover plate is functionally equivalent to the second cover plate.

17. The method of claim 16, wherein at least one of the first cover plate, the first end cap, the second cover plate, and the second end cap is formed out of a material selected from a group consisting of wood, metal, plastic, stone, and combinations thereof.

18. The method of claim 16, wherein:

the configuration of the first cover plate includes at least one of shape and indicia;

the configuration of the second cover plate includes at least one of shape and indicia;

the configuration of the first end cap includes at least one of shape and indicia;

the configuration of the second end cap includes at least one of shape and indicia.

19. The method of claim 16, wherein the configuration of at least one of the first cover plate, the second cover plate, the first end cap, and the second end cap includes at least one of a logo, an initial, seasonal indicia, artwork, and advertising indicia.

20. The method of claim 16, wherein:

the configuration of the first cover plate and the configuration of the first end cap collectively present a first theme; and the configuration of the second cover plate and the configuration of the second end cap collectively present a second theme.

21. The method of claim 20, wherein at least one of the first theme and the second theme is a seasonal theme.

* * * * *